US010029353B2

(12) United States Patent
Hsieh

(10) Patent No.: US 10,029,353 B2
(45) Date of Patent: Jul. 24, 2018

(54) CONTROL DEVICE FOR RATCHET WRENCH

(71) Applicants: Kuan Jen Hsieh, Taichung (TW); Kai Lin Hsieh, Taichung (TW)

(72) Inventor: Kuan Jen Hsieh, Taichung (TW)

(73) Assignees: Kuan Jen Hsieh, Taichung (TW); Kai Lin Hsieh, Taichung (TW)

( * ) Notice: Subject to any disclaimer, the term of this patent is extended or adjusted under 35 U.S.C. 154(b) by 328 days.

(21) Appl. No.: 15/059,164

(22) Filed: Mar. 2, 2016

(65) Prior Publication Data

US 2017/0050299 A1 Feb. 23, 2017

(30) Foreign Application Priority Data

Aug. 21, 2015 (TW) ..... 104213619 U

(51) Int. Cl.
*B25B 13/46* (2006.01)

(52) U.S. Cl.
CPC ..... *B25B 13/463* (2013.01)

(58) Field of Classification Search
CPC ..... B25B 13/462; B25B 13/463
See application file for complete search history.

(56) References Cited

U.S. PATENT DOCUMENTS

| | | | | |
|---|---|---|---|---|
| 6,761,091 | B2 * | 7/2004 | Hsien | B25B 13/463 192/43.2 |
| 6,805,027 | B2 * | 10/2004 | Hsien | B25B 13/463 192/43.2 |
| 6,886,428 | B1 * | 5/2005 | Hsien | B25B 13/463 81/63 |
| 7,938,043 | B2 * | 5/2011 | Hu | B25B 13/463 81/63 |
| 8,387,489 | B2 * | 3/2013 | Hsu | B25B 13/06 81/124.5 |
| 2006/0000317 | A1 * | 1/2006 | Chen | B25B 13/463 81/63.2 |
| 2012/0031240 | A1 * | 2/2012 | Hsieh | B25B 13/463 81/63.2 |

* cited by examiner

*Primary Examiner* — David B Thomas
(74) *Attorney, Agent, or Firm* — Alan D. Kamrath; Kamrath IP Lawfirm, P.A.

(57) ABSTRACT

A ratchet wrench includes a head having a first room for receiving a driving member, and a second room for receiving a pawl. Two recesses are defined in the inner periphery of the second room. A tip portion is located between the two recesses. The tip portion passes through the two respective centers of the first and second rooms. The pawl is controlled by a bolt and a lever. A spring and a contact member are received in a positioning hole in the rear side of the pawl. The contact member is biased by the spring and engaged with one of the two recesses to push the pawl to be engaged with the driving member. The contact member is restricted between one of the two recesses and the positioning hole so as to bear a large torque.

10 Claims, 5 Drawing Sheets

CONTROL DEVICE FOR RATCHET WRENCH

BACKGROUND OF THE INVENTION

1. Fields of the Invention

The present invention relates to a control device for a ratchet wrench, and more particularly, to a control device for precisely control the pawl during operation of the ratchet wrench.

2. Descriptions of Related Art

The conventional ratchet wrench is disclosed in FIG. 10 and generally comprises a body 1 with a head 10 in which a first room 101 for receiving a driving member 13 therein, and a second room 102 for receiving a pawl 15 are defined. A recess 103 is defined in the inner periphery of the second room 102 so as to receive a spring 110 and a bead 111 therein. The bead 111 is biased by the spring 110 to be engaged with one of the notches 115 of the pawl 15 to force the teeth 151 on either one of two ends of the pawl 15 to be engaged with the teeth 130 of the driving member 13.

However, when drilling the recess 103, the body 1 has to be put on the drilling machine at an angle, and the drill is not perpendicular to the inner periphery of the second recess 102. The drill is easily damaged or even broken during drilling.

Besides, when assembling pawl 15 into the second room 102, the spring 110 biases the bead 111 which protrudes into the second room 102, so that the bead 111 may easily be shifted by the pawl 15 and this may take a lot of time.

The present invention intends to provide a control device for a ratchet wrench so as to improve the shortcomings mentioned above.

SUMMARY OF THE INVENTION

The present invention relates to a ratchet wrench and comprises a body having a head which has a first room and a second room which communicates with the first room. Two recesses are defined in the inner periphery of the second room. A tip portion extends from the inner periphery of the second room and is located between the two recesses. The tip portion passes through the center of the first room and the center of the second room. A second hole is defined through the underside of the head and communicates with the second room. A driving member is rotatably received in the first room and has a ratchet teeth defined in the outer periphery thereof. A driving head extends from one side of the driving member.

A pawl is pivotably located in the second room and has a connection portion. Each of two ends of the front side of the pawl has engaging teeth respectively defined therein. A positioning hole is defined in the rear side of the pawl and faces the two recesses. A spring and a contact member are received in the positioning hole of the pawl. The contact member is biased by the spring so as to be engaged with one of the two recesses in the second room. The engaging teeth are selectively engaged with the ratchet teeth of the driving member. The contact member is restricted between either of the two recesses and the positioning hole to bear a large torque.

A bolt extends through the second hole and is connected to the connection portion of the pawl. A lever is mounted to the bolt and controls the pivotal action of the pawl. A cover is fixed to the top of the head of the body to restrict the driving member and the pawl in the head.

Preferably, the maximum depth from a line starts from the start point of each of the two recesses to the final point of each of the two recesses to the inner periphery of either of the two recesses is smaller than the diameter of the contact member.

Preferably, the pawl has a flat face defined in the rear side thereof. The maximum depth from the flat face to either of the two recesses is smaller than the diameter of the contact member.

Preferably, the contact member has a semi-spherical face or a rounded portion defined in the front end thereof. The contact member is a cylindrical member, or a metal cylindrical member.

Preferably, the maximum width from the start point of each of the two recesses to the final point of each of the two recesses is larger than the diameter of the contact member.

Preferably, the pawl is pivotal such that the positioning hole is moved between the start point of one of the two recesses to the final point of the other recess.

Preferably, a first hole is defined through the underside of the underside of the head and communicates with the first room. The protrusion of the driving member extends through the first hole.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
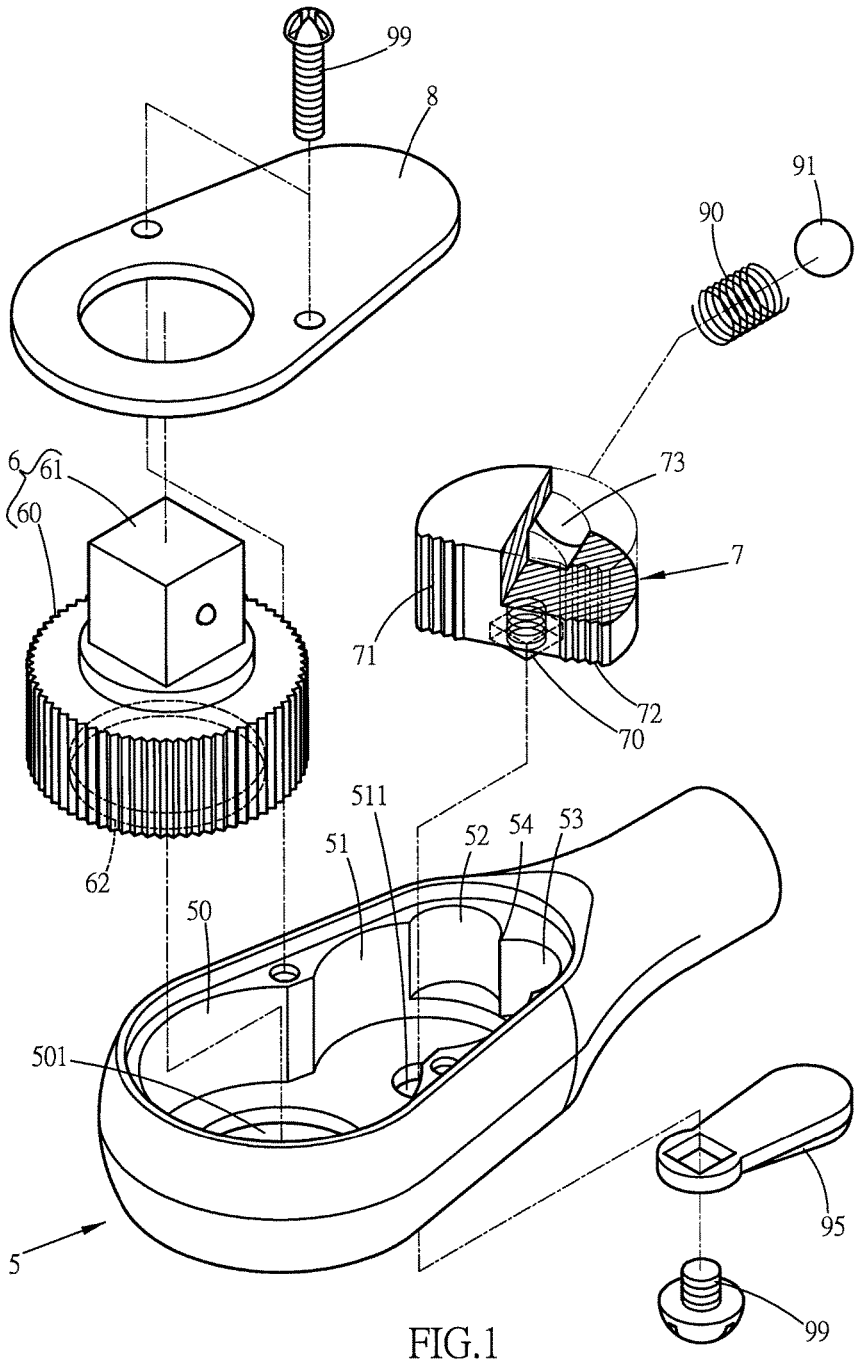
FIG. 1 is an exploded view of the ratchet wrench of the present invention.

Referring to FIGS. 1 to 7, the ratchet wrench of the present invention comprises a body 5 having a head which has a first room 50 and a second room 51 defined therein, wherein the second room 51 communicates with the first room 50. Two recesses 52, 53 are defined in the inner periphery of the second room 51, and a tip portion 54 extends from the inner periphery of the second room 51 and is located between the two recesses 52, 53. The tip portion 54 passes through the center of the first room 50 and the center of the second room 51. A first hole 501 and a second hole 511 are respectively defined through the underside of the head, wherein the first hole 501 communicates with the first room 50, and the second hole 511 communicates with the second room 51.

A driving member 6 is rotatably received in the first room 50 and has a ratchet teeth 60 defined in the outer periphery thereof. A driving head 61 extends from one side of the driving member 6, and a protrusion 62 protrudes from the other side of the driving member 6. The protrusion 62 extends through the first hole 501.

Figure 2:
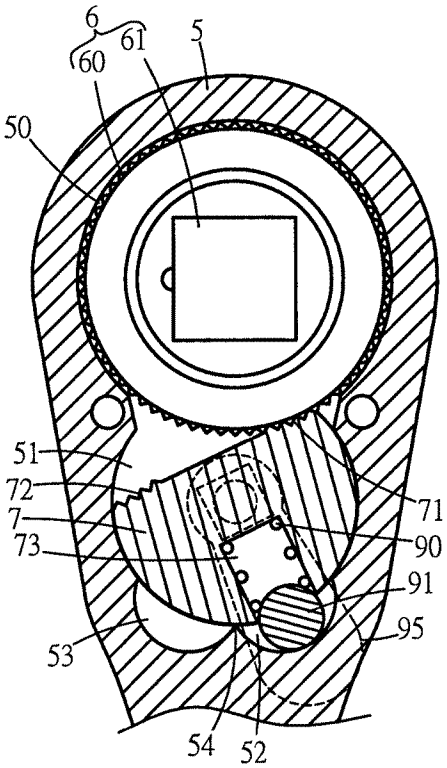
FIG. 2 is a cross sectional view of the ratchet wrench of the present invention.
Figure 5:
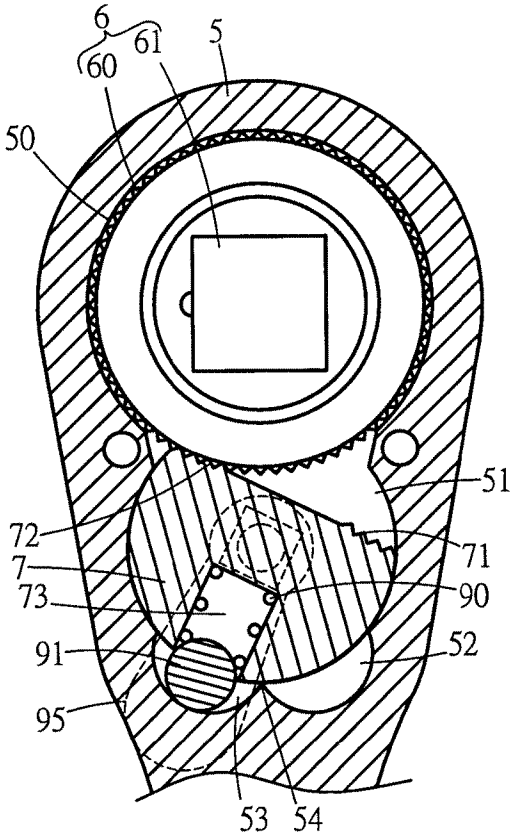
FIG. 5 is a cross sectional view of the ratchet wrench of the present invention, wherein the contact member is moved to the other recess.

A pawl 7 is pivotably located in the second room 51 and has a connection portion 70 which extends through the second hole 511 of the head. Each of two ends of the front side of the pawl 7 has engaging teeth 71, 72 respectively defined therein. A positioning hole 73 is defined in the rear side of the pawl 7. The positioning hole 73 faces the two recesses 52, 53. Specifically, the range of the movement of the positioning hole 73 starts from the start pint of the recess 52 as shown in FIG. 2, to the final point of the other recess 53 as shown in FIG. 5.

A spring 90 and a contact member 91 are received in the positioning hole 73 of the pawl 7. The contact member 91 is biased by the spring 90 so as to be engaged with one of the two recesses 52, 53 in the second room 51. In this embodiment, the contact member 91 is a bead or metal ball. The engaging teeth 71, 72 are selectively engaged with the ratchet teeth 60 of the driving member 6. The contact member 91 is restricted between either of the two recesses 52, 53 and the positioning hole 73 to bear a large torque. A bolt 99 extends through the second hole 511 and is connected to the connection portion 70 of the pawl 7. A lever 95 is mounted to the bolt 99 and controls the pivotal action of the pawl 7. When the user pivots the lever 95, the pawl 7 is pivoted within the second room 51.

A cover 8 is fixed to the top of the head of the body 5 to restrict the driving member 6 and the pawl 7 in the head.

Figures 6, 7:
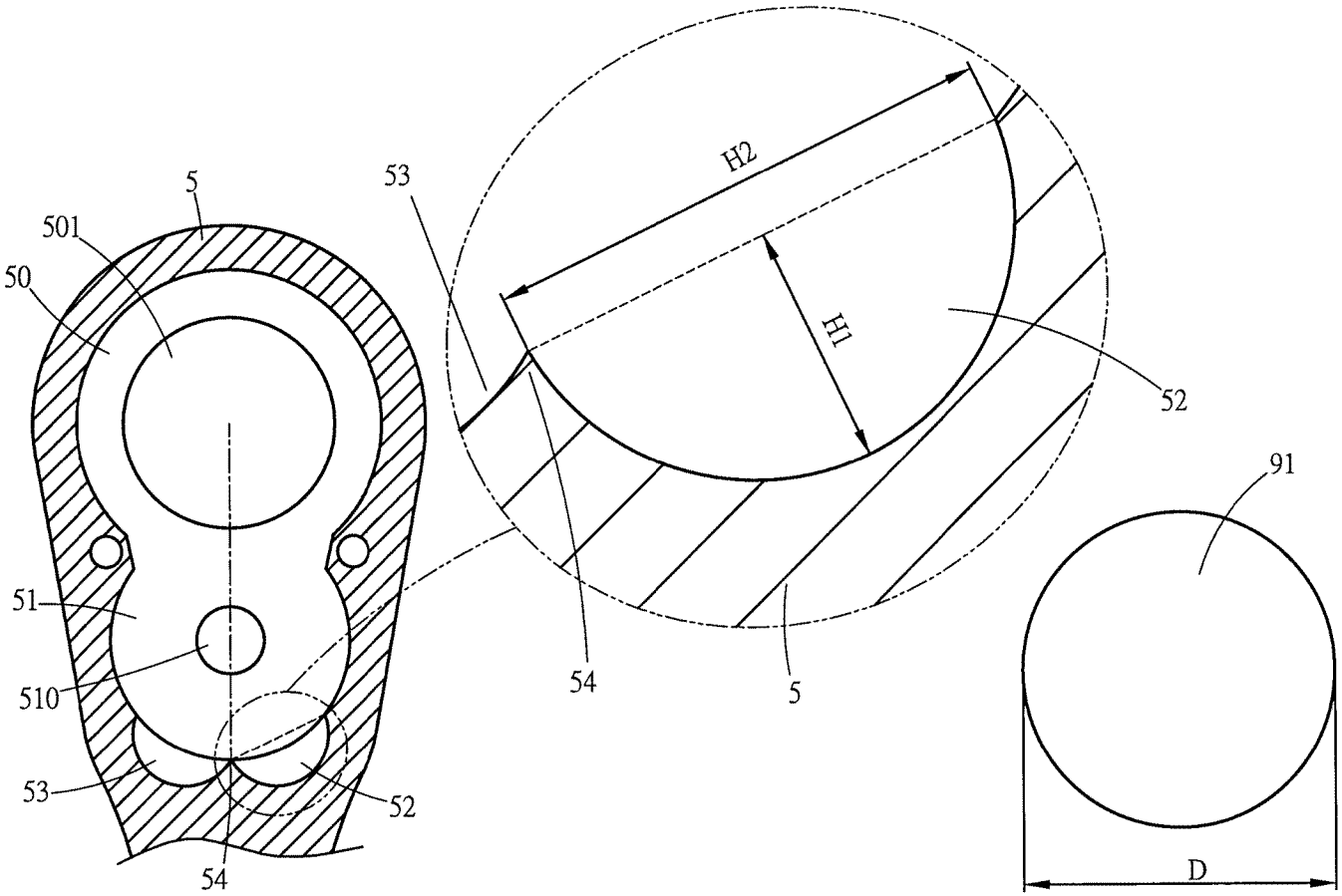
FIG. 6 shows the size of the tow recesses of the ratchet wrench of the present invention.
FIG. 7 shows the size of the contact member of the ratchet wrench of the present invention.
Figure 10:
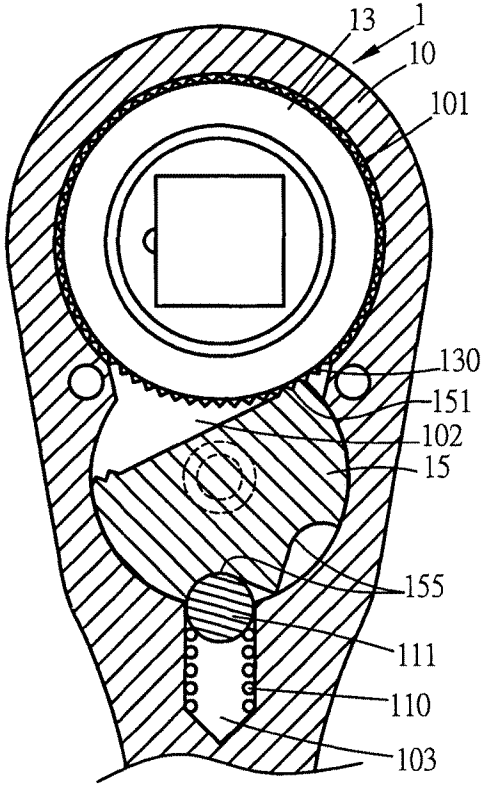
FIG.10 PRIOR ART
FIG. 10 shows the conventional ratchet wrench.

As shown in FIGS. 6 and 7, the maximum depth H1 from a line starts from a start point of each of the two recesses 52, 53 to a final point of each of the two recesses 52, 53 to an inner periphery of either of the two recesses 52, 53 is smaller than a diameter D of the contact member 91. The maximum depth H3 from the flat face 74 to either of the two recesses 52, 53 is smaller than the diameter D of the contact member 91.

The first and second rooms 50, 51 can be directly drilled from the top of the head, and which is easy and efficient without damaging the drills.

When assembling, the user simply holds the pawl 7 and one finger covers the positioning hole 73 to push the contact member 91 into the positioning hole 73. The pawl 7 can be installed in the second room 51. The contact member 91 is then biased by the spring 90, and the engaging teeth 71 are engaged with the ratchet teeth 60 of the driving member 6. The cover 8 and the lever 95 are then respectively connected to the head and the connection portion 70 of the pawl 7 by bolts 99 or a C-clip.

Figure 4:
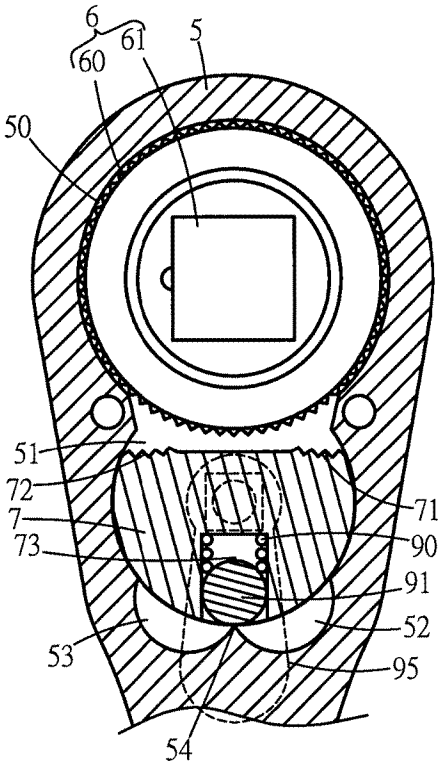
FIG. 4 is a cross sectional view of the ratchet wrench of the present invention, wherein the contact member is moved on the tip portion.
Figure 3:
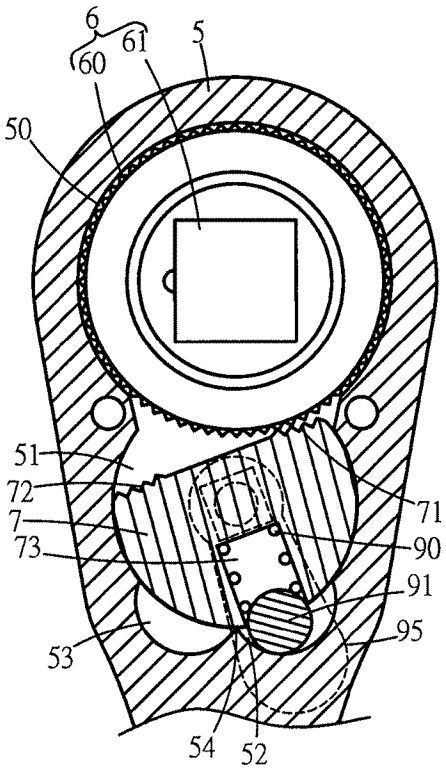
FIG. 3 is a cross sectional view of the ratchet wrench of the present invention, wherein the contact member is moved toward the tip portion.

When in use, as shown in FIGS. 3 to 5, the user switches the lever 95 clockwise to pivot the pawl 7 clockwise, as shown in FIG. 3, the engaging teeth 71 gradually are disengaged from the ratchet teeth 60 until the engaging teeth 71 are completely disengaged from the ratchet teeth 60. The positioning hole 73 is pivoted and the contact member 91 moves toward the tip portion 54 until the contact member 91 is pushed into the positioning hole 73, and then the contact member 91 is able to enter into the other recess 53. The tip portion 54 provides a maximum resistance when the contact member 91 moves from one recess to the other.

When rotating the body 5 counter clockwise, the pawl 7 is rotated to engage the engaging teeth 71 with the ratchet teeth 60, the contact member 91 is clamped between the recess 52 and the positioning hole 73 so as to output a large torque.

Figure 8:
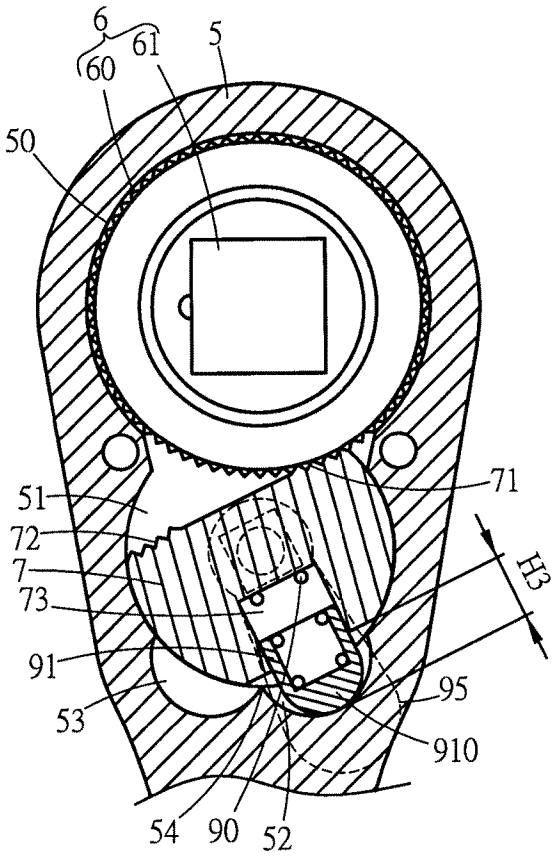
FIG. 8 is a cross sectional view to show another embodiment of the ratchet wrench of the present invention.

As shown in FIG. 8, the contact member 91 has a semi-spherical face 910 defined in the front end thereof. The contact member 91 is a cylindrical member, or a metal cylindrical member. The pawl 7 has a flat face 74 defined in the rear side thereof, and the positioning hole 73 is defined in the flat face 74. The maximum depth H3 from the flat face 74 to either of the two recesses 52, 53 is smaller than the diameter D of the semi-spherical face 910 of the contact member 91.

Figure 9:
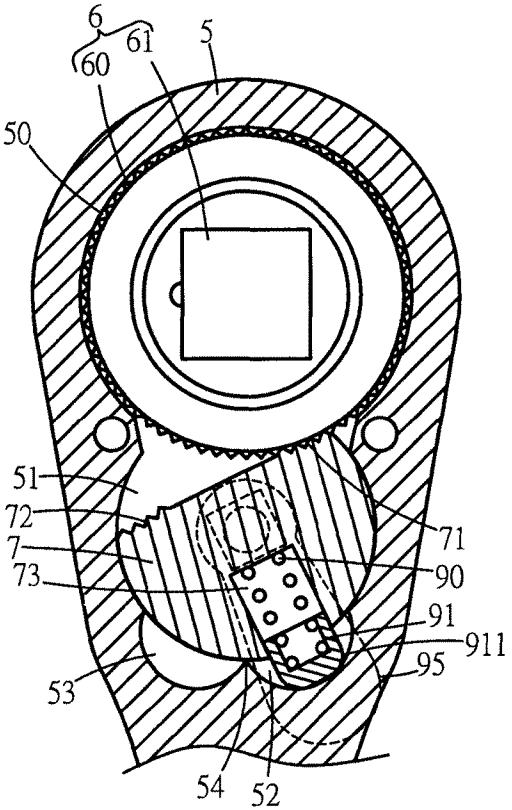
FIG. 9 is a cross sectional view to show yet another embodiment of the ratchet wrench of the present invention.

FIG. 9 shows yet another embodiment of the present invention, wherein the contact member 91 has a rounded portion 911 defined in the front end thereof. The contact member 91 is a cylindrical member, or a metal cylindrical member. The maximum width H2 from the start point of each of the two recesses 52, 53 to the final point of each of the two recesses 52, 53 is larger than the diameter D of the rounded portion 911 of the contact member 91.

While we have shown and described the embodiment in accordance with the present invention, it should be clear to those skilled in the art that further embodiments may be made without departing from the scope of the present invention.

What is claimed is:

1. A ratchet wrench comprising:

a body having a head which has a first room and a second room which communicates with the first room, two recesses defined in an inner periphery of the second room, a tip portion extending from the inner periphery of the second room and located between the two recesses, the tip portion passing through a center of the first room and a center of the second room, a second hole defined through an underside of the head and communicating with the second room;

a driving member rotatably received in the first room and having a ratchet teeth defined in an outer periphery thereof, a driving head extending from one side of the driving member;

a pawl pivotably located in the second room and having a connection portion, each of two ends of a front side of the pawl having engaging teeth respectively defined therein, a positioning hole defined in a rear side of the pawl and facing the two recesses;

a spring and a contact member received in the positioning hole of the pawl, the contact member being biased by the spring so as to be engaged with one of the two recesses in the second room, the engaging teeth being selectively engaged with the ratchet teeth of the driving member, the contact member being restricted between either of the two recesses and the positioning hole to bear a large torque;

a bolt extending through the second hole and connected to the connection portion of the pawl, a lever mounted to the bolt and controlling the pivotal action of the pawl, and a cover fixed to a top of the head of the body to restrict the driving member and the pawl in the head.

2. The ratchet wrench as claimed in claim 1, wherein the contact member is a bead or metal ball.

3. The ratchet wrench as claimed in claim 2, wherein a maximum depth from a line starts from a start point of each of the two recesses to a final point of each of the two recesses to an inner periphery of either of the two recesses is smaller than a diameter of the contact member.

4. The ratchet wrench as claimed in claim 3, wherein a maximum width from the start point of each of the two recesses to the final point of each of the two recesses is larger than the diameter of the contact member.

5. The ratchet wrench as claimed in claim 4, wherein the pawl is pivotal such that the positioning hole is moved between the start point of one of the two recesses to a final point of the other recess.

6. The ratchet wrench as claimed in claim 5, wherein a first hole is defined through the underside of the underside of the head and communicates with the first room, a protrusion of the driving member extends through the first hole.

7. The ratchet wrench as claimed in claim 2, wherein the pawl has a flat face defined in the rear side thereof, a maximum depth from the flat face to either of the two recesses is smaller than a diameter of the contact member.

8. The ratchet wrench as claimed in claim 1, wherein the contact member has a semi-spherical face or a rounded portion defined in a front end thereof, the contact member is a cylindrical member, or a metal cylindrical member.

9. The ratchet wrench as claimed in claim 8, wherein a maximum depth from a line starts from a start point of each of the two recesses to a final point of each of the two recesses to an inner periphery of either of the two recesses is smaller than a diameter of the contact member.

10. The ratchet wrench as claimed in claim 9, wherein the pawl has a flat face defined in the rear side thereof, a maximum depth from the flat face to either of the two recesses is smaller than a diameter of the contact member.

* * * * *